US005417045A

United States Patent [19]

Otoshima

[11] Patent Number: 5,417,045

[45] Date of Patent: May 23, 1995

[54] TRAVELLER CHANGER

[75] Inventor: Hiroo Otoshima, Shiga, Japan

[73] Assignee: Murata Kikai Kabushiki Kaisha, Kyoto, Japan

[21] Appl. No.: 73,898

[22] Filed: Jun. 9, 1993

[30] Foreign Application Priority Data

Jun. 11, 1992 [JP] Japan ..... 4-047262 U

[51] Int. Cl.[6] ..... D01H 7/52

[52] U.S. Cl. ..... 57/1 R; 57/75; 57/262; 57/279; 57/353; 29/765

[58] Field of Search ..... 57/1 R, 279, 75, 353, 57/262; 29/765

[56] References Cited

FOREIGN PATENT DOCUMENTS 86517 4/1993 Japan ..... 57/262
86522 4/1993 Japan ..... 57/262
86524 4/1993 Japan ..... 57/262
86526 4/1993 Japan ..... 57/262

*Primary Examiner*—Joseph J. Hail, III
*Attorney, Agent, or Firm*—Spensley Horn Jubas & Lubitz

[57] ABSTRACT

A traveller changer in which a first operating portion having a tensor for absorbing the slack of yarn passed through a traveller in a ring spinning frame, and a second operating portion having a yarn hooking lever, a traveller removing element and a traveller mounting elements are provided on a carrier unit, the first operating portion being disposed at a predetermined certain height relative to the carrier unit, and the second operating portion being disposed vertically movably in arrowed directions with respect to the carrier unit so that it can follow up the height of a ring rail.

4 Claims, 13 Drawing Sheets

TRAVELLER CHANGER

BACKGROUND OF THE INVENTION

1. Field of the Invention

The present invention relates to a traveller changer for automatically changing a traveller fitted on a ring of a ring spinning frame. Particularly, the invention is concerned with a traveller changer in which a tensor for absorbing the slack of yarn which has been slackened for traveller change is sure to operate.

2. Prior Art

A ring spinning frame using a traveller will first be described with reference to FIG. 19. A ring spinning frame 101 has a twisting mechanism 102 and a drafting mechanism 103. The drafting mechanism 103 comprises a pair of upper and lower back rollers 104, a pair of upper and lower middle rollers 106 each having an apron 105, and a pair of upper and lower front rollers 107, arranged successively from above to below. The upper roller of each roller pair is supported so as to permit opening and closing by means of a cradle arm, while the lower roller of each roller pair is driven. A sliver or roving S of a large diameter passes through the drafting mechanism 103 into yarn. The yarn then passes through the twisting mechanism 102 about to be described, into spun yarn. The twisting mechanism 102 comprises a spindle 1 onto which is fitted a bobbin 2, a ring rail 4 capable of traversing and movable vertically in the longitudinal direction of the bobbin 2, a ring 5 fixed to the ring rail 4, a traveller 7 fitted on a flange 6 of the ring 5 and capable of travelling in the circumferential direction, a ballooning control ring 9 and a snail wire 8, these components being arranged successively from below to above. The spindle 1 is allowed to rotate at a high speed of usually 10,000 to 20,000 r.p.m. by means of a belt 3 which is common to plural spindles. Yarn Y is wound onto the bobbin 2 through the snail wire 8, ballooning control ring 9 and further through the traveller 7. As the bobbin 2 rotates, the traveller 7 is pulled by the yarn and travels on the flange 6 of the ring 5, thereby twisting the yarn. Between the bobbin 2 and the traveller 7 there is a difference in the number of revolutions which corresponds to the length of yarn fed from above. The yarn is wound by this length onto the bobbin 2. Thus, the ring 5 and the traveller 7 serves not only as a frictional resistor for inducing a difference in the number of revolutions but also as a travelling direction changing mechanism for performing both twisting and winding operations.

The traveller 7 is a C-shaped metallic piece and is fitted on the flange 6 of the ring 5. Since the traveller 7 rotates on the flange 6 at a high speed of 10,000 to 20,000 r.p.m., it wears out, and hence every week or two it is necessary to change the traveller 7 from old to new one. The conventional traveller changing method is a manual method. More particularly, an old traveller is removed using a suitable pawl piece, and then a new traveller is mounted, using a traveller mounting device as a manual tool where required.

Since the conventional traveller changing method is a manual method although it uses a tool, if all the travellers in a ring spinning frame having a large number of spindles are to be changed, a considerable time is required even for a skilled worker. Thus, a special worker for the change of travellers is required.

Because of such inconvenience, an automatic traveller changer has come to be desired. For automatic change of a traveller, a bobbin is rotated reversely to slacken the yarn passed on the traveller. The slack of the yarn is absorbed by a tensor. Then, the bobbin is rotated forward, allowing the traveller to travel until it is hooked by a traveller removing device. The yarn is shifted onto a ring by means of a yarn hooking lever. A new traveller is mounted and thereafter the old traveller is removed. The slacken yarn is tensed by rotating the bobbin forward. Thus, many operations are required and it is necessary to perform these operations efficiently.

The ring rail 4 in FIG. 10 moves up and down in a section L and in which position in the section L it is to stop is indefinite. However, the yarn which is absorbed its slack by the tensor is located in a higher position than the snail wire 8, which position is not influenced by the vertical movement of the ring rail 4. In the case where a tensor and a traveller changer are provided integrally with each other, therefore, there is a fear of the tensor operation becoming uncertain because of a positional change of yarn absorbed by the tensor.

SUMMARY OF THE INVENTION

The present invention has been accomplished in view of the above-mentioned problem and it is a first object of the invention to provide a traveller changer in which yarn can surely be absorbed its slack by a tensor irrespective of the position of a ring rail.

It is a second object of the invention to provide traveller changing method and apparatus in which when an old traveller is removed at the time of traveller change, there is little fear of yarn breakage.

According to the present invention there is provided a traveller changer including a carrier unit; a first operating portion having a tensor for absorbing the slack of yarn passed through a traveller in a ring spinning frame; and a second operating portion having, a traveller removing means and a traveller mounting means, the first and second operating portions being mounted on the carrier unit, the first operating portion being disposed at a predetermined height with respect to the carrier unit, and the second operating portion being mounted vertically movably relative to the carrier unit so that it can follow up the height of a ring rail.

The tensor provided in the first operating portion assumes a certain height irrespective of the height of the second operating portion and absorbs the slack of yarn at the most appropriate part.

According to the present invention, in order to achieve the above-mentioned second object, there is provided a method for changing a traveller fitted on a ring and with yarn passed therethrough, the yarn extending to a yarn feed bobbin, in which the yarn is shifted in a crossing form over the circumference of the ring between upper and lower yarn portions with respect to the traveller, and there are performed traveller mounting and removing operations in a floating state of at least the ring.

A traveller changer provided for realizing the above method according to the present invention includes a yarn hooking lever, a traveller mounting means and a traveller removing means, the yarn hooking lever comprising a rotary shaft capable of advancing toward a ring with a traveller fitted thereon, a bent member formed at a front end of the rotary shaft, a lower yarn hooking portion for the traveller formed at one end of the bent member near the rotary shaft and an upper yarn hooking portion for the traveller formed at an opposite end of the bent member.

Since yarn is shifted in a crossing form over the circumference of a ring between upper and lower yarn portions with respect to the traveller and the traveller is removed in a floating state of at least the upper yarn portion from the ring, the old traveller can be removed while an appropriate elasticity to an escaping degree from the traveller remains in the yarn.

As the rotary shaft of the yarn hooking lever rotates, the lower yarn hooking portion and the upper yarn hooking portion of the bent member shift the lower and upper yarns in a crossing form over the ring, and the upper yarn can be held in a floating state by adjusting the degree of rotation.

BRIEF DESCRIPTION OF THE DRAWINGS

FIG. 16 is a structural diagram of a wheel used in an operation unit in the third embodiment;

DETAILED DESCRIPTION OF PREFERRED EMBODIMENTS

Figure 1:
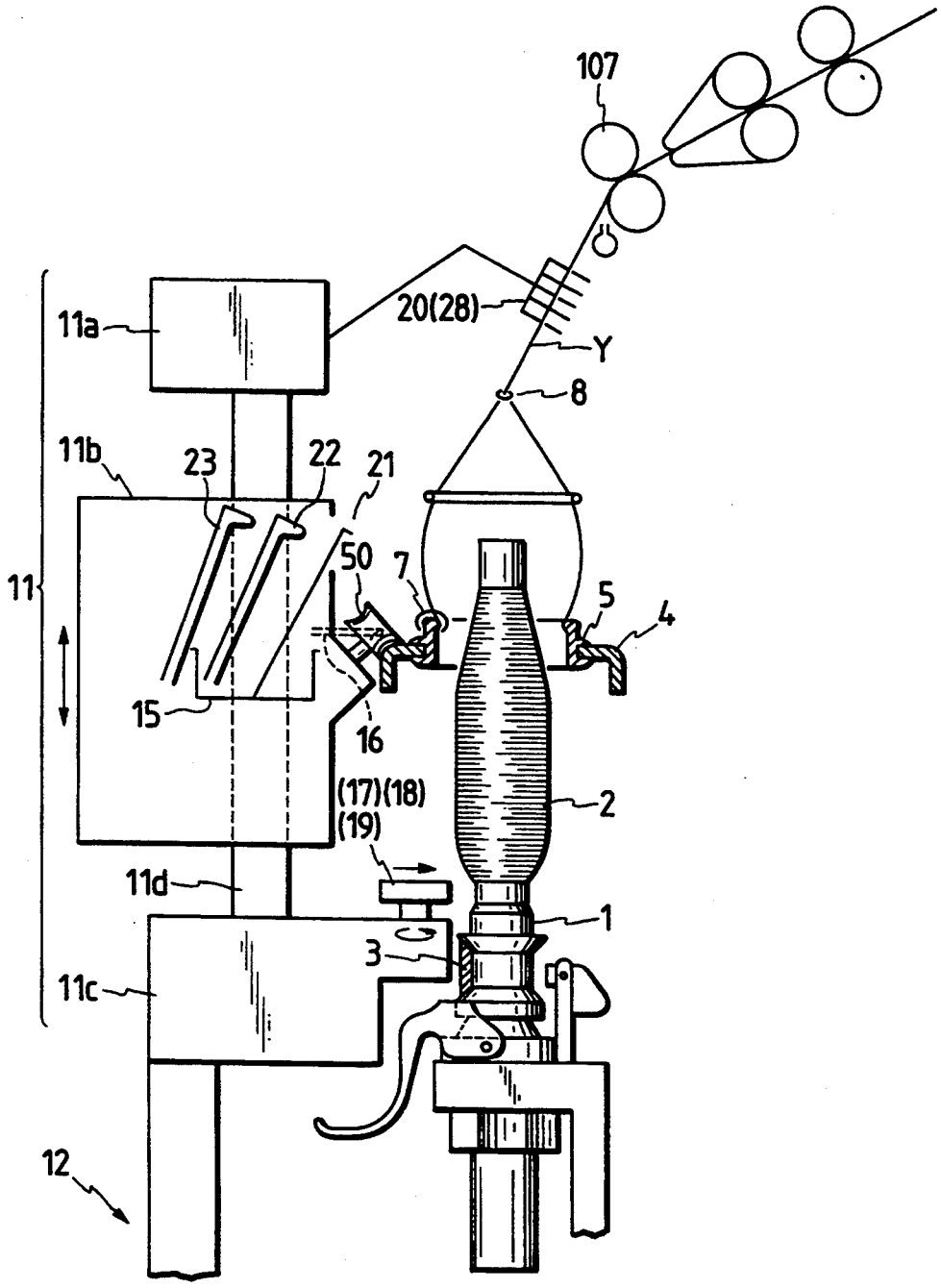
FIG. 1 is a side view of an operation unit in a traveller changer embodying a first embodiment of the present invention.
Figure 2:
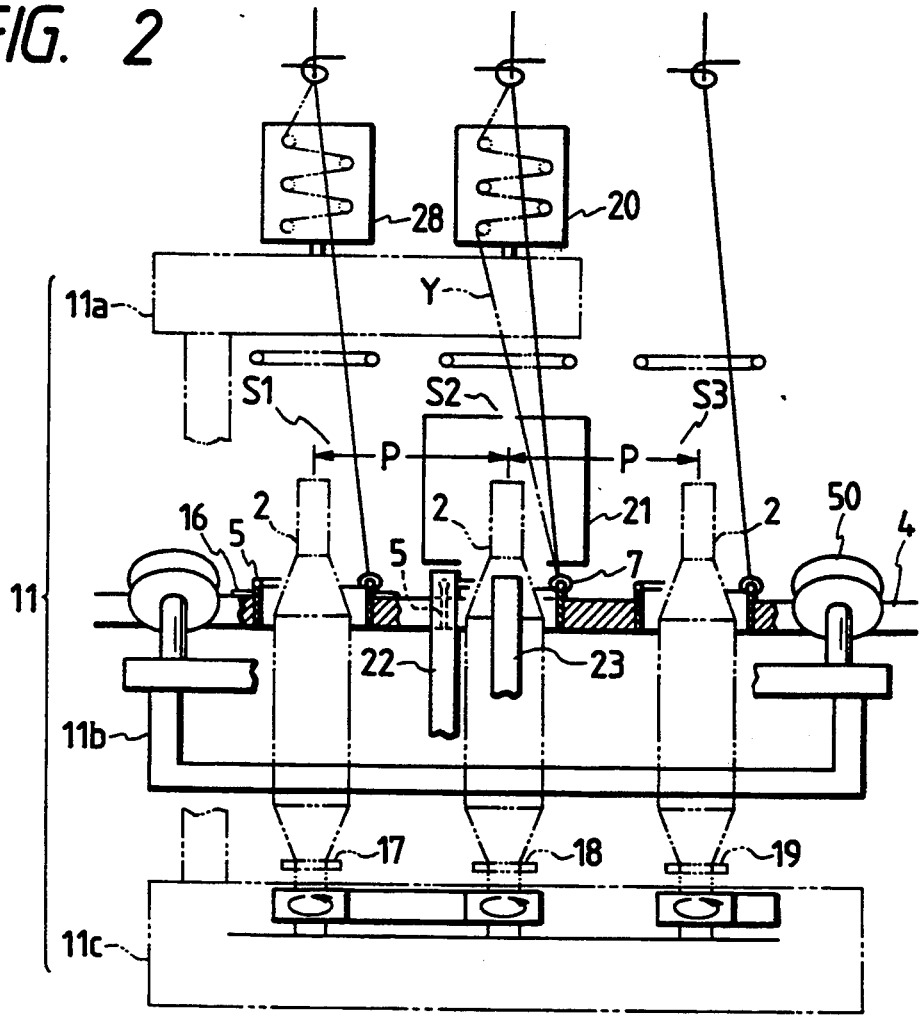
FIG. 2 is a front view thereof.
Figure 3:
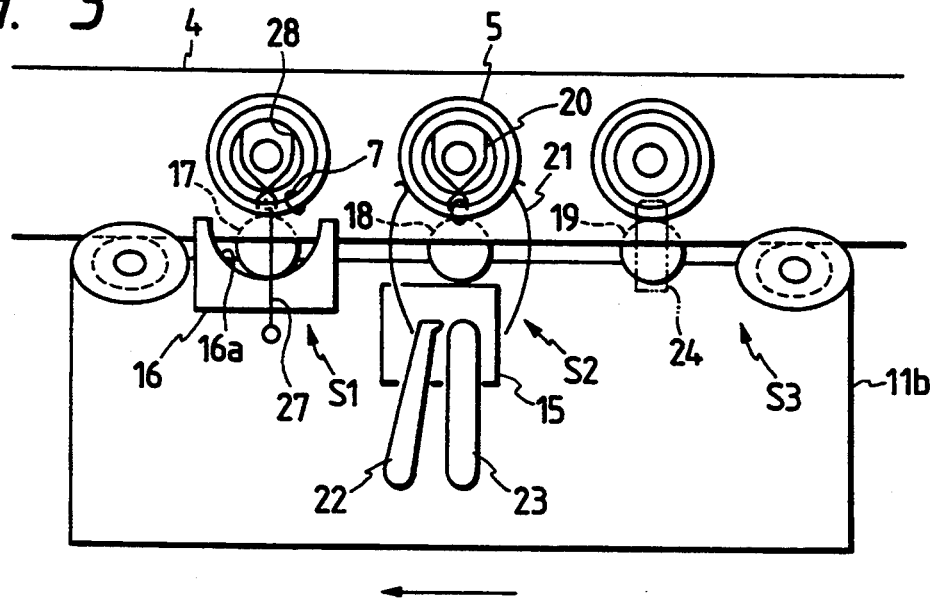
FIG. 3 is a top view of a second operating portion in the traveller changer.

A first embodiment of the present invention will be described hereinunder with reference to the drawings. FIG. 1 is a side view of an operating unit in a traveller changer embodying the invention, FIG. 2 is a front view thereof, FIG. 3 is a top view of a second operating portion in the traveller changer, and FIG. 4 is a view showing the whole of the traveller changer. First, the whole of the traveller will be described below with reference to FIG. 4, which will be followed by a detailed description of the operating unit used therein.

Figure 4B:
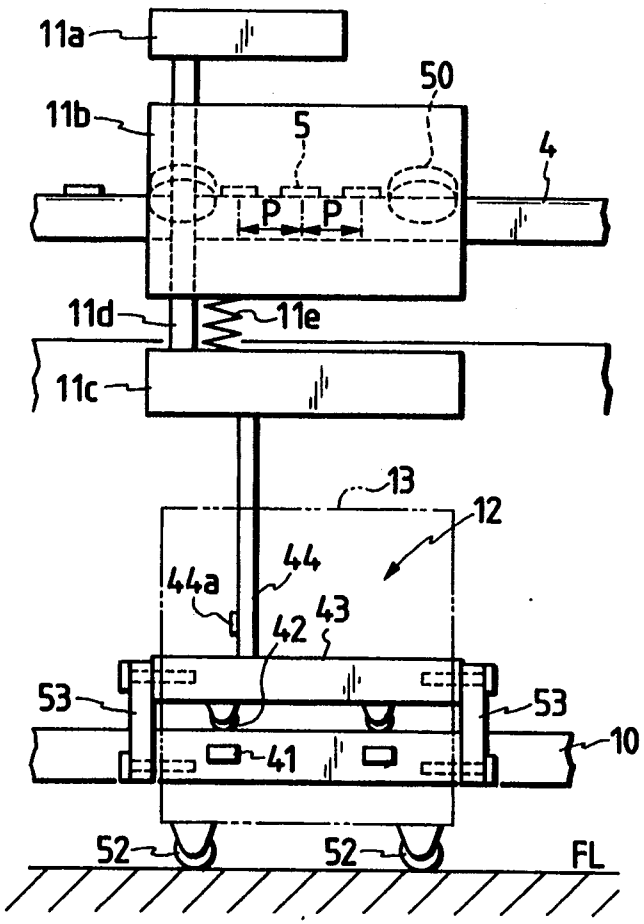
FIG. 4*a* is a side view showing the whole of the traveller changer of the first embodiment and Fig. 4*b* is a front view thereof.
Figure 4A:
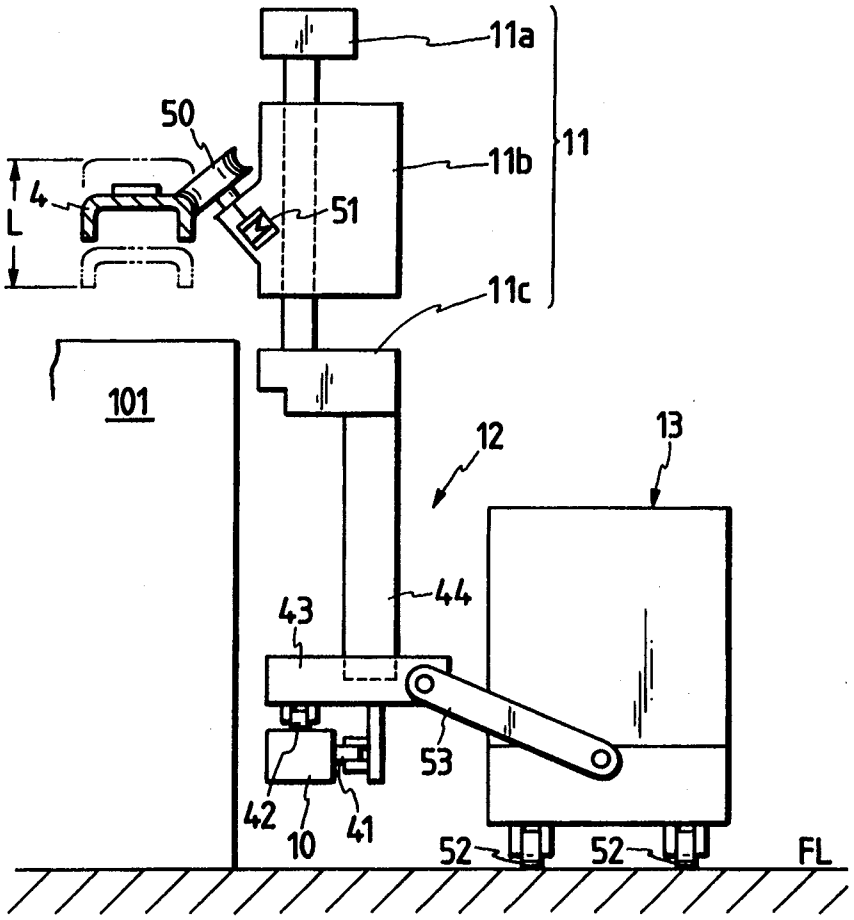

FIG. 4*a* is a side view and FIG. 4*b* is a front view. In these figures, the traveller changer embodying the invention comprises a carrier unit 12 which supports an operation unit 11 and a power control carrier 13 which is connected to the carrier unit 12. The carrier unit 12 comprises a base 43 to which are mounted wheels 41 and 42 for a rail in a ring spinning frame, and a plate spring 44 implanted in the base 43. To an end of the plate spring 44 is mounted the operation unit 11. The operation unit 11 comprises a first operating portion 11*a*, a third operating portion 11*c*, which are positioned respectively above and below a guide rod 11*d*, and a second operating portion 11*b* which is movable vertically through a linear bearing with respect to the guide rod 11*d*. Further, a compression spring 11*e* is provided between the third operating portion 11*c* and the second operating portion 11*b*, so that the second operating portion 11*b* is substantially reduced in weight to permit its smooth vertical movement.

The second operating portion 11*b* has 45° inclined wheels 50 adapted to roll on a corner of the ring rail 4. A magnet is fitted in a recess formed in the outer periphery of each wheel 50, whereby the wheels 50 are attracted to the ring rail corner. In this state, the wheels 50 are each driven rotatively by a motor 51 or a link and cam mechanism, so that the whole of the operation unit 11 moves quickly by a distance corresponding to a ring arrangement pitch P. Then, the operation unit 11 is positioned to a ring on the ring rail 4 by means of a positioning mechanism.

The power control carrier 13 has wheels 52 for travelling on the surface of a floor, which wheels permit a follow-up travel. The power control carrier 13 and the base 43 of the carrier unit 12 are interconnected through links 53. Since the power control carrier 13 usually carries a lead storage battery thereon and has a weight two to three times the weight of the operation unit 11, it is rendered movable on the floor surface in a separated state.

The following description is now provided about the mounting and travelling of the above traveller changer with respect to the ring spinning frame. In FIG. 4, when the links 53 are raised to bring the base 43 and the power control carrier 13 into an engaged state, whereby the whole of the traveller changer can be transported by the wheels 52 of the carrier 13. Then, the operator transports the traveller changer up to a portion of the ring spinning frame requiring traveller change. Upon arrival at such portion, the links 53 are lowered to put the wheels 41 and 42 on the rail 10. During operation, the ring rail 4 in the ring spinning frame moves up and down in the section of stroke L. Therefore, when the spinning frame turns off, the ring rail 4 stops at an optional height within the stroke L. Therefore, the operator adjusts the height of the second operating portion 11*b* while moving it vertically, thereby allowing the wheels 50 to be attracted to a corner of the ring rail 4.

For the change of ring, the wheels 50 are rotated in a predetermined manner by the motor 51 or the like, whereby the whole of the operation unit 11 can travel for each arrangement pitch P of the rings 5 on the ring rail 4. The travelling of the operation unit 11 is transmitted to the base through the plate spring 44 and further transmitted to the power control carrier 13 through the links 53, so that the whole of the traveller changer travels. In the presence of the plate spring 44, the operation unit 11 can move a very small distance; that is, the positioning of the operation unit 11 for the ring 5 can be done by a small force.

Reference is here made to FIGS. 1 to 3 to explain in what manner the components of the operation unit 11 are arranged. In FIGS. 1 and 2, the first operating portion 11*a* is provided with tensors 20 and 28 for absorbing the slack of yarn; the second operating portion 11*b* is provided with a positioning plate 16 having a semicircular portion to be fitted on the ring 5, a yarn hooking lever 21, a traveller removing means 22, a traveller mounting means 23 and a recovery box 15; and the third operating portion 11*c* is provided with rollers 17, 18 and 19 capable of coming into abutment with the lower portions bobbins 2.

Laterally in the operating portions 11*a*, 11*b* and 11*c*, as shown in FIGS. 2 and 3, there are formed first, second and third stations S1, S2, S3. In the first station S1 there are provided the positioning plate 16, roller 17 capable of moving into contact with and away from the bobbin 2, and tensor 28. In the second station S2 there are provided the positioning plate 16, roller 18 capable of moving into contact with and away from the bobbin 2, tensor 20, yarn hooking lever 21, traveller removing means 22, traveller mounting means 23 and recovery box 15. In the third station S3 there are provided the roller 19 capable of moving into contact with and away from the bobbin 2 and a slack eliminating means 24. The positioning plate 16, tensors 20, 28, yarn hooking lever 21, traveller removing means 22, traveller mounting means 23 and slack eliminating means 24, except the rollers 17, 18 and 19, are operated by a train of cams mounted on a common cam shaft.

Referring back to FIG. 2, the rollers 17, 18 and 19 can abut side faces of three bobbins 2 and can be rotated each independently by means of a motor. Assuming that the operation unit 11 performs traveller changing operations from the right to the left in the figure, the roller 17 in the first station S1 rotates the bobbin 2 in the reverse direction to slacken the yarn, allowing the yarn to be stored in the tensor 28. The roller 18 in the second station S2 rotates the bobbin 2 in the forward direction, allowing the traveller 7 to move to a predetermined position, which position is determined by the traveller removing means serving as a stopper as will be described below, while winding up the yarn stored in the tensor 20. The roller 19 in the third station S3 rotates the bobbin 19 forward to eliminate the slack of the yarn and bring the yarn into a tense state.

Figure 5A:
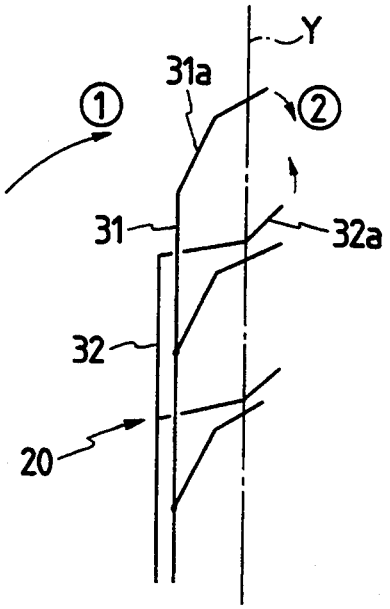
FIG. 5*a* and 5*b* are perspective views showing the structure and operation of a tensor.
Figure 5B:
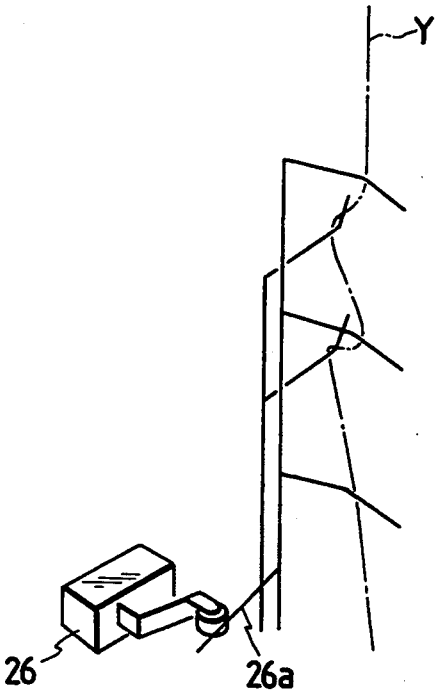

FIG. 5 shows the structure and operation of the tensor 28 in the first station S1 and that of the tensor 20 in the second station S2, in which FIG. 5*a* shows the state before operation and FIG. 5*b* shows the state after operation. As shown in FIG. 5*a*, the tensors 20 and 28 each comprise a pair of combs 31 and 32 capable of coming into mesh with each other, the comb 31 having three pawls 31*a* and the comb 32 having two pawls 32*a*. When the tensor 20 advances in the direction of ① from a retracted position thereof, the yarn Y is positioned between the pawls 31*a* and 32*a*. Then, when the pawls 31*a* and 32*a* come into mesh in the direction of ② and assumes the state shown in FIG. 5*b*, the yarn y becomes zigzag, whereby the slack is absorbed and the yarn Y is stored. The tensor 28 in the first station S1 has a meshing stroke sufficient to absorb the entire slack of the yarn slacked by the roller 17 to thereby prevent the occurrence of kinky thread on the downstream side between the traveller 7 and bobbin 2. The tensor 28 releases the yarn Y prior to one pitch travel of the operation unit 11. Although kinky thread occurs in the yarn Y upon such yarn release, since that position is on the upstream side of the traveller, the kinkiness is eliminated by the tensor 20 in the second station S2 and the whole of the yarn thread is absorbed by the tensor. After the meshing of the combs, a predetermined tension falling Under the range not causing yarn breakage can be imparted to the yarn Y. Particularly in the tensor 28 using the meshable combs 31 and 32, since the yarn Y is in a zigzag absorbed state, many small kinky threads are dispensed along the zigzag shape of the released yarn Y. Because smaller kinky threads are easier to be eliminated by the tensor, the slack of the yarn Y is surely absorbed by the tensor 20 in the second station S2.

The tensor 20 in the second station S2 is provided in order that the yarn hooking lever which will be described below can surely hook the yarn Y in a tense state and shift the yarn in a preslackened range thereof. At the base portion of the tensor 20 there is mounted a detector piece 26*a* so that a yarn tension can be detected through a limit switch 26, which switch 26 operates as follows. First, the tensor 20 advances in the direction of ① and the pawls 31*a* and 32*a* come into mesh with each other in the direction of ②, Next, the limit switch 26 detects whether there is a sufficient slack in the tensor 20. If the slack of the yarn Y is insufficient, the limit switch 26 will not turn ON (the operation of the yarn hooking lever which will be described below becomes incomplete). In the case of insufficient slack, a roller (not shown) is rotated reversely to deliver yarn from a yarn feed bobbin, whereupon the limit switch 26 will turn ON and a sufficient slack of the yarn Y detected. Next, the roller (not shown) is rotated forward to take up the yarn onto the feed bobbin, thereby causing the traveller to move to the predetermined position. When the traveller stops in the predetermined position, the yarn becomes tense, so that the limit switch 26 turns OFF and the yarn tension is detected, making sure that there is no obstacle to the subsequent operation. Although a gate tensor using a pair of combs has been described above as an example of the tensors 20 and 28, there may be used an air tensor which absorbs the slack of yarn by suction of air. However, the gate tensor is preferred because the air tensor requires an air source.

As shown in FIG. 1, the tensors 20 and 28 are provided in the first operating portion 11*a* and are fixed to the carrier unit 12 through the guide rod 11*d*. Both are held at a certain constant height. Thus, the tensors 20 and 28 operate in an intermediate position between the snail wire 8 and the front rollers 107. On the other hand, the second operating portion 11*b* is movable vertically relative to the guide rod 11*d*, or the carrier unit 12, so that it can follow up a stop position of the ring rail 4. It can be set at a desired height.

Figure 6A:
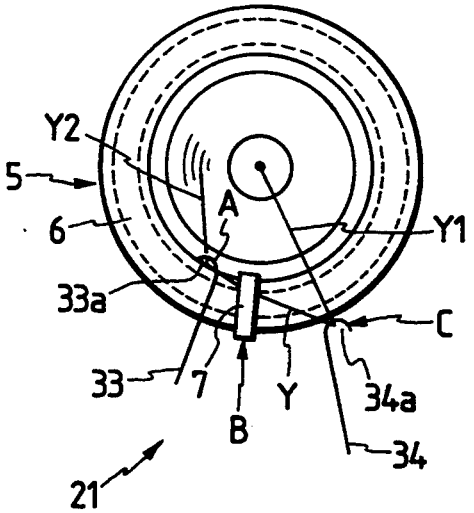
FIG. 6*a* is a view showing the structure and operation of a yarn hooking lever of the first embodiment and FIG. 6*b* is a view showing a position of a yarn.
Figure 6B:
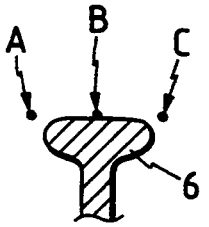

FIG. 6 illustrates the structure and operation of the yarn hooking lever, in which FIG. 6*a* is a top view and FIGS. 6*b*, 6*c* and 6*d* illustrate states of yarn. In FIG. 6*a*, the yarn hooking lever 21 comprises a pair of levers 33 and 34 having front ends formed as hook portions 33*a* and 34*a* respectively. The hook portion 33*a* shifts yarn Y2 located downstream of the traveller 7, inwards of the flange 6, while the hook portion 34*a* shifts yarn Y1 located upstream of the traveller 7, outwards of the flange 6, thus holding the yarn Y so as to cross the upper surface of the flange obliquely. In this case, the yarn portions at point A of the hook portion 33*a*, point C of the hook portion 33*b* and point B as a middle point are located in the positions shown in FIG. 6*b* relative to the flange 6. Therefore, once the traveller 7 is mounted in the position of point B in FIG. 6*a*, the yarn Y is hooked by the traveller 7. It is preferred that an old traveller be removed by the traveller removing means after mounting of a new traveller by the traveller mounting means to prevent the yarn Y from being carried together with the old traveller. In this case, it is necessary that the two new and old travellers be positioned in the crossing portion A-C. If the yarn is held in such a manner that the start point A of the crossing portion A-C substantially overlaps a tangent to the inner circle of the ring 5, it is possible to make the crossing portion A-C longest. The larger the deviation from the tangent to the inner circle, the shorter the crossing portion A-C. Prior to the operation of the yarn hooking lever 21, the traveller removing means 22 which will be described below assumes a predetermined position, and an arm 35 thereof serves as a stopper to stop the traveller 7 which travels with the forward rotation of the roller 18, in a predetermined position.

FIG. 7 illustrates the structure and operation of the traveller removing means. As shown in FIGS. 7*a* and 7*b*, the traveller removing means 22 comprises the arm 35 and a pawl 35*a* formed as a traveller removing member at a front end of the arm 35. The arm 35 can rotate in the direction indicated at (6) with respect to a cylindrical member 39. To the cylindrical member 39 is attached a presser plate 40 as a fixing member. As the pawl 35*a* of the arm 35 rotates in the (6) direction, the traveller 7 can be taken in and held by both a front end 40*a* of the presser plate 40 and the pawl 35*a*. The whole of the cylindrical member 39 can advance in the direction of (7). Further, the arm 35 also serves as a stopper for the traveller 7. More specifically, when the roller 18 shown in FIG. 2 rotates forward and the yarn is taken up, the traveller 7 moves, enters between the presser plate 40 and the pawl 35*a*, abuts the arm 35 and stops, as shown in FIG. 76. Then, as the arm 35 turns in the (6) direction, the traveller 7 is taken in and caused to float from the flange 6 of the ring, as shown in FIG. 7C. Further, as the cylindrical member 39 advances in the (7) direction, the traveller 7 becomes disengaged from the ring flange 6 as shown in FIG. 7*d*. When the traveller removing means 22 has advanced to a predetermined position, if the traveller 7 is present in a position in which it comes into contact with the traveller removing means, the removal of the traveller will end in failure. As shown in FIG. 3, therefore, the traveller 7 is pushed away from such position of contact with the traveller removing means 22 by a lever 27 of an elastic material.

Figure 8A:
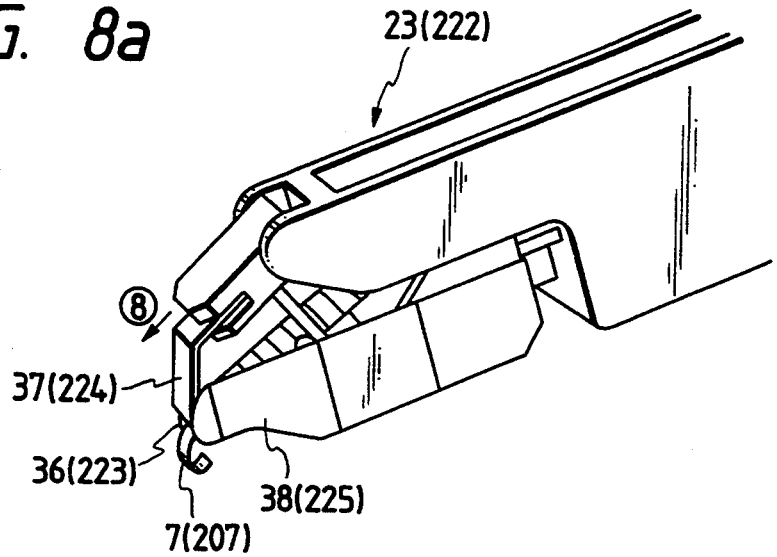
FIG. 8*a* is a perspective view showing the structure and operation of a traveller mounting means of the first embodiment and FIG. 8*b* is a partly enlarged view thereof.
Figure 8B:
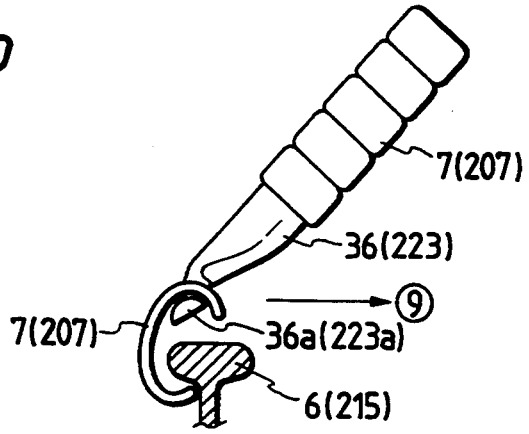

FIG. 8 illustrates the structure and operation of the traveller mounting means, in which FIG. 8*a* is a perspective view of the whole and FIG. 8*b* is an enlarged view of a principal portion thereof. In FIG. 8*a*, the traveller mounting means 23 comprises an arm 36 with a large number of travellers 7 fitted thereon, a delivery member 37 and a plate spring 38. As the delivery member 37 moves in the direction of (8), one traveller 7 is delivered to the front while being held down. As shown in FIG. 8*b*, a front end 36*a* of the arm 36 is bent so that the traveller is held in C shape vertically. When the whole of the traveller mounting means 23 moves back in the direction of (9), the traveller 7 is fitted on the ring flange 6. At the same time, the traveller 7 which has become free is sprung away to the inner side in the paper thickness direction by the plate spring 38.

Figure 9:
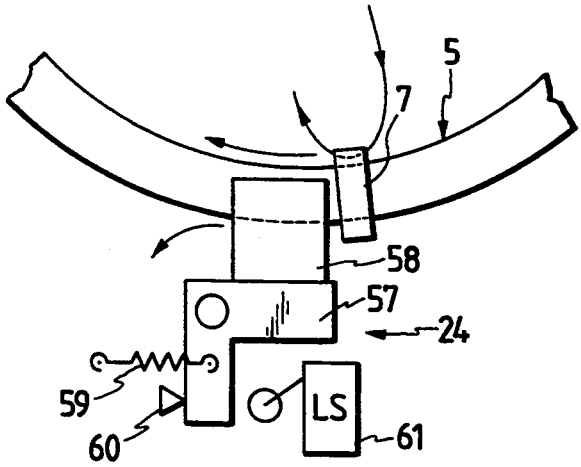
FIG. 9 is a view showing the structure and operation of a yarn tension sensor of the first embodiment.

FIG. 9 is a top view showing the structure and operation of the yarn slack eliminating means. The yarn slack eliminating means 24 comprises an L-shaped lever 57 and a brush 58 implanted in one arm of the brush 57. It retains its illustrated posture through a spring 59 and a stopper 60 both operating on the other arm of the lever. Further, a limit switch 61 is disposed for the other arm of the lever 57. As the bobbin is rotated forward by the roller 19 shown in FIG. 2, the yarn in a slackened state is wound up, while when the yarn becomes tense, the traveller 7 moves along the ring 5 and thrusts into the brush 58, causing the lever 57 to move pivotally in the counterclockwise direction. Consequently, the limit switch 61 operates and the tense state of the yarn is detected, so the rotation of the roller is stopped. Thus, it is necessary to make the yarn tense after the change of the traveller 7, or else there will occur breakage of the yarn at the time of start-up of the ring spinning frame.

Figure 7A:
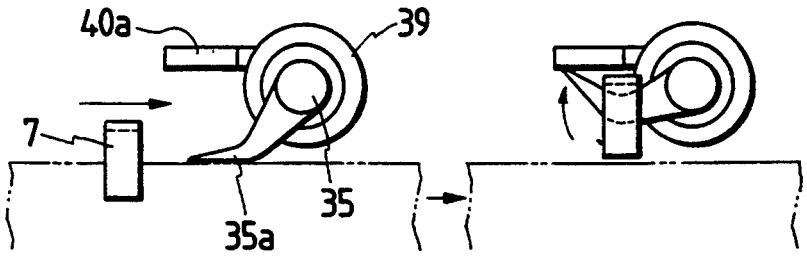
FIGS. 7*a*, 7*c* and 7*d* are views showing the structure and operation of a traveller removing means of the first embodiment.

The following description is now provided about a traveller changing method using the traveller changer described above. In FIG. 2, the operation unit 11 has three stations S1, S2 and S3. In the first station S1, the yarn is slackened to prevent the occurrence of kinky thread on the downstream side of traveller. In the second station S2, there is performed the change of traveller. And in the third station S3, the yarn is made tense. Thus, roles are separated, and by performing the operations at a time, the cycle time is shortened. More specifically, in the first station S1, the positioning plate 16 advances until it is fitted on the ring 5, whereby the operation unit 11 is positioned. Next, the roller 17 advances and causes the bobbin 2 to rotate in the reverse direction to slacken the yarn. The slack of the yarn is absorbed by the tensor 28. After the tensor 28 has released the yarn, the operation unit 11 moves to the left in the figure by only one pitch P. Next, the yarn Y is again stored in a zigzag from by the tensor 20 in the second station S2 and can now be delivered or fed at a predetermined yarn tension. At this time, since there is no kinky thread on the downstream side of the traveller 7, the whole of the slackened yarn is stored in the tensor 20. Then, as shown in FIG. 7*a*, the arm 35 of the traveller removing means 22 advances to a predetermined position on the flange 6. Next, with forward rotation of the roller 18, the yarn Y thus stored in the tensor is delivered, and with rotation of the yarn the traveller 7 moves clockwise along the ring 5. The traveller 7 is then retained by the pawl 35*a* of the arm 35 shown in FIG. 7*a* and hence the movement of the traveller 7 stops in a predetermined position. At this time, the roller 18 is rotated by a preset number of times under control of a controller. Then, the yarn hooking lever 21 hooks the yarn Y and shifts it in a crossing manner over the flange 6 of the ring 5 from above while allowing the yarn stored in the tensor to be further delivered. As a result, the yarn Y is held in a position not causing any obstacle to the mounting and removal of the traveller 7, as shown in FIG. 6*a*.

Figure 7B:
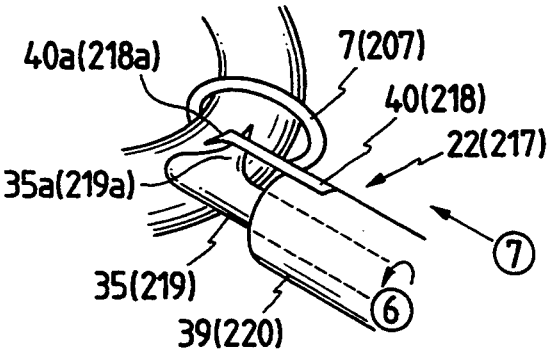
Figure 7C:
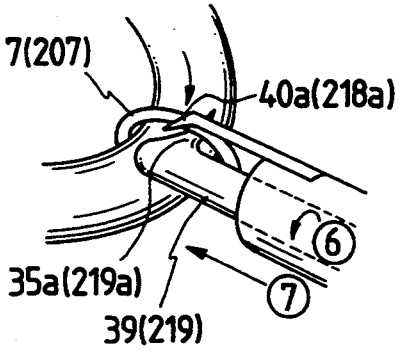

Next, as shown in FIG. 8*a*, the traveller 7 held in C shape by the arm 36 advances to a predetermined position for the ring flange 6 and the whole of the traveller mounting means moves back in the (9) direction. The outer end of the traveller 7 is drawn out and fitted on the flange 6 while the inner end thereof is kept hooked to the flange. Then, the traveller 7 is sprung away to the inner side in the paper thickness direction in the same figure by means of the plate spring 38. Next, as shown in FIG. 7*b*, the arm 35 rotates in the (6) direction and the pawl 35*a* and the front end 40*a* take in the traveller 7. Thereafter, as the arm 35 advances in the (7) direction, the traveller 7 becomes disengaged from the ring flange 6, as shown in FIG. 7*c*. The traveller 7 is now kept retained by the pawl 5*a* and the front end 40*a*. With retraction of the traveller removing means 22, the traveller 7 is carried to the position above the recovery box 15 shown in FIG. 3 and is dropped into the same box when the pawl 35*a* and the front end 40*a* move away from each other.

Thereafter, the yarn hooking lever 21 shown in FIG. 6 returns to its original retracted position and the slack of yarn is again stored in the tensor 20 shown in FIG. 2, which tensor is thereafter released. The tensor 20 then returns to its original retracted position, and the operation unit 11 moves to the left in FIG. 2 by one pitch P. Next, the roller 19 rotates forward, and when a tense state of yarn is detected by the slack eliminating means 24 shown in FIG. 9 and the roller 19 stops, there is no longer the slack of yarn and thus the original state is obtained. In this way, the change of traveller which has heretofore been considered impossible unless manual labor is used, can be performed completely automatically. In the manual change of traveller, old travellers are scattered, but since the traveller changer of the present invention is provided with an old traveller recovery box, it is no longer necessary to clean the surroundings of the ring spinning frame.

Although the traveller changer having two sets of tensors in the first operating portion 11*a* has been described above, it is also possible to use only the tensor 20 provided in the second station S2.

In the traveller changer of the present invention, the first operating portion having tensors is disposed at a predetermined certain height relative to the carrier unit, and the second operating portion in the traveller changer is provided vertically movably relative to the carrier unit so that it can follow up the height of the ring rail. The tensors are held at a certain constant height irrespective of the height of the second operating portion which moves vertically while following up the height of the ring rail, and absorb the slack of yarn at the most appropriate portion. Therefore, there is no fear of the tensor operation becoming uncertain and hence the traveller changing operation is ensured.

As described above, for automatic change of a traveller, upper and lower yarns passed through the traveller are shifted in a crossing form over the ring and thereafter the traveller removing means and the traveller mounting means are operated. However, if the traveller removing operation is performed mechanically by the traveller removing means, it is impossible to make such delicate operation and adjustment as in manual operation, thus resulting in that yarn is hooked to the traveller which is removed, causing breakage of the yarn and ending in failure of the traveller changing operation.

A second embodiment of the present invention has been accomplished in view of the above-mentioned problem and it provides traveller changing method and apparatus in which when an old traveller is removed at the time of traveller change, there is little fear of yarn breakage.

Figure 10:
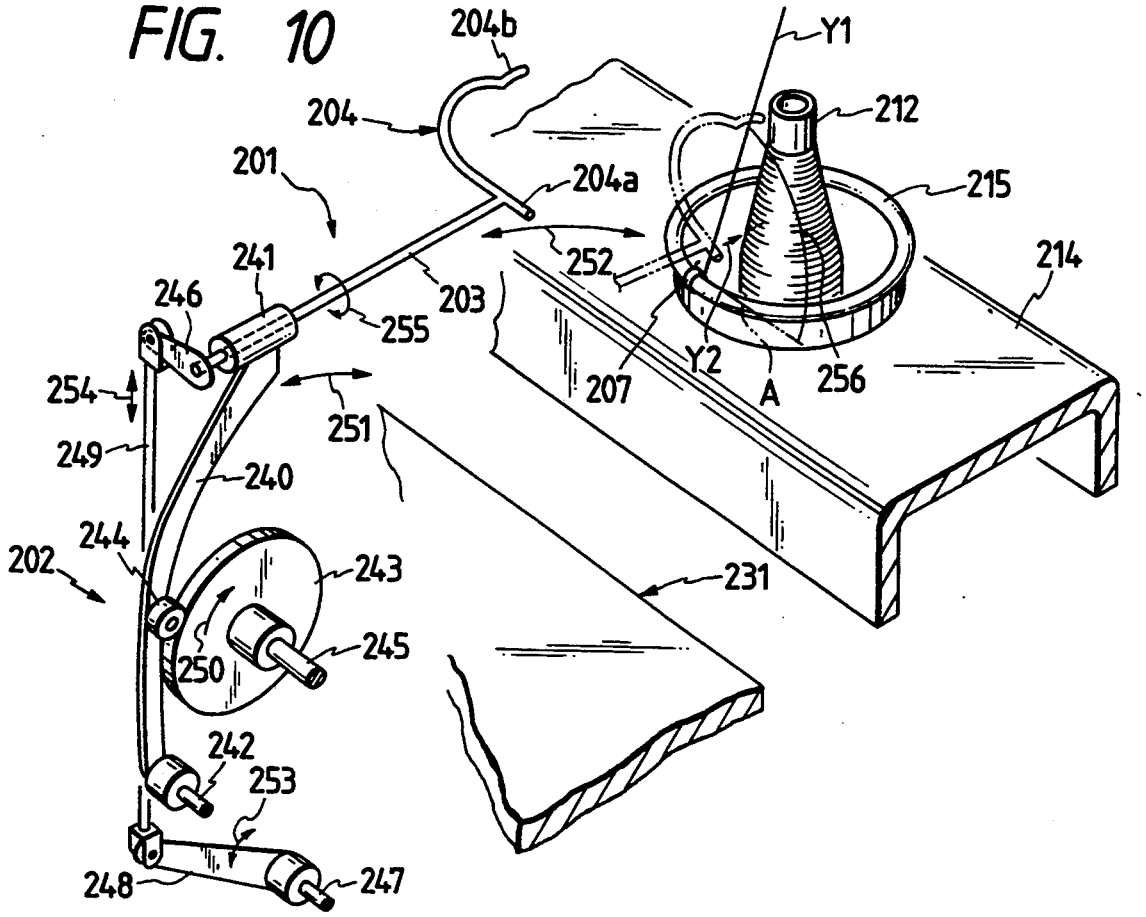
FIG. 10 is a perspective view showing a yarn hooking lever in a traveller changer according to a second embodiment of the present invention.

A second embodiment of the present invention will now be described with reference to the drawings. FIG. 10 is a perspective view showing the structure and operation of a yarn hooking lever used in a traveller changer embodying the invention. In FIG. 10, the numeral 207 denotes a traveller, numeral 212 denotes a yarn feed bobbin, numeral 214 denotes a ring rail, numeral 215 denotes a ring, numerals Y1 and Y2 denote upper and lower yarns, respectively, with respect to the traveller 207.

Numeral 231 denotes an operation unit in the traveller exchanger. In the operation unit 231 there are provided a yarn hooking lever 201 and a drive mechanism 202 for the lever 201. The yarn hooking lever 201 comprises a rotary shaft 203 and a bent member 204 formed at a front end of the rotary shaft 203. One end of the bent member 204 is formed as a lower yarn hooking portion 204*a* projecting short in the direction normal to the rotary shaft 203. The bent member 204 is bent in approximately a half circle and an opposite end thereof is bent at right angles in the direction of the rotary shaft 203, then further bent in "<" shape to form an upper yarn hooking portion 204*b*.

The rotary shaft 203 is supported rotatably by a housing 241 provided at a front end of a pivotable lever 240. The pivotable lever 240 which is pivotable about a shaft 242 as a fulcrum is urged toward a cam 243 by means of a tension spring (not shown). In an intermediate position of the pivotable lever 240 there is disposed a roller 244, which rolls on the cam 243. A large number of cams are fitted in a shaft 245 of the cam 243, and a traveller removing means and a traveller mounting means, which will be described later, are operated by those cams which rotate together with the shaft 245. Further, a rotary arm 246 attached to a rear end of the rotary shaft 203 and a rotary arm 248 fitted on a shaft 247 are interconnected through a rod 249.

When the cam 243 rotates once in the direction of arrow 250, the housing 241 oscillates like arrow 251, so that the yarn hooking lever 201 performs a series of advancing, stopping and retreating operations with respect to the ring. In the state indicated by a dash-double dot line after advancing and stop of the yarn hooking lever 201 with respect to the ring, the shaft 247 rotates within a predetermined angle like arrow 253, the rod 249 moves up and down like arrow 254, the rotary shaft 203 rotates like arrow 255, and the bent member 204 performs a motion like arrow 256. The lower yarn hooking portion 204*a* of the bent member 204 shifts the lower yarn Y2 to the inner periphery side of the ring 215, while the upper yarn hooking portion 204*b* of the bent member shifts the upper yarn Y1 in a crossing form over the ring 215. Whether the upper yarn Y1 is to assume a floating state over the ring 215 or a pushed state against the ring 215 is determined by a turning angle of the rotary shaft 203.

Figure 11A:
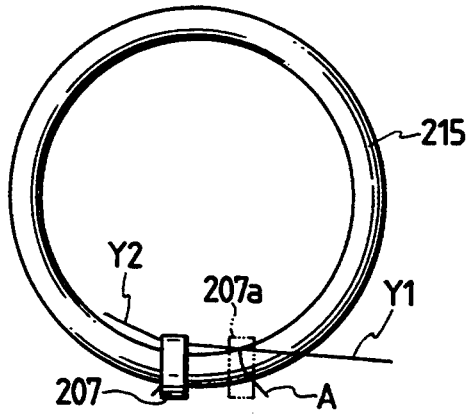
FIG. 11*a* is a top view showing a yarn hooking position and FIG. 11*b* is a side view thereof.
Figure 11B:
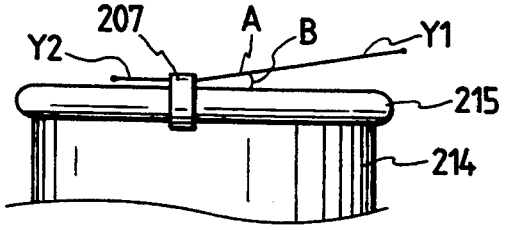

FIG. 11 illustrates a yarn hooking position, in which FIG. 11*a* is a top view and FIG. 11*b* is a side view. The yarn Y is hooked and shifted by the yarn hooking lever so as to cross the ring 215 on the side where the traveller 207 is at a standstill. The mark A represents an intersecting point of the yarn and the ring 215, indicating a position where a new traveller 207*a* is to be mounted. At point A, as shown in FIG. 11*b*, there is a space B between the upper yarn Y1 and the ring 215, that is, the yarn Y1 is in a floating state above the circumference of the ring 215.

Figure 7D:
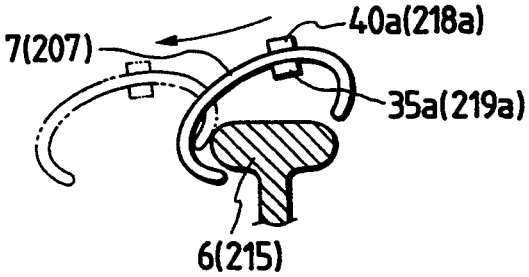

The structure and operation of a traveller removing means 217 will now be described with reference to FIGS. 7*b*, 7*c* and 7*d*. The traveller removing means 217 has a pawl 219*a* formed at a front end of an arm 219 as a removing member for the traveller 207. The arm 219 is rotatable in the direction indicated by ⑥ relative to a cylindrical member 220. To the cylindrical member 220 is attached a presser plate 218 as a fixing member. As the pawl 219*a* of the arm 219 rotates in the ⑥ direction, the traveller 207 can be taken in and held by both a front end 218*a* of the presser plate 218 and the pawl 219*a*. The whole of the cylindrical member 220 can advance in the direction of ⑦. Further, the arm 219 also serves as a stopper for the traveller 207.

As the yarn is taken up, the traveller 207 moves and enters between the presser plate 218 and the pawl 219*a*, then strikes against the arm 219 and stops, as shown in FIG. 7*b*. Then, when the arm 219 rotates in the ⑥ direction, the traveller 207 is taken in and floated from the ring 215, as shown in FIG. 7*c*. Further, with forward movement in the ⑦ direction of the cylindrical member 220, the traveller 207 becomes disengaged from thering 215, as in FIG. 7*d*.

A principal portion of a traveller mounting means 222 is shown in FIG. 8*a*. The traveller mounting means 222 comprises a guide member 223 with a large number of travellers 207 fitted thereon, a delivery member 224 and a plate spring 225. The guide member 223 is for guiding travellers one by one to one end side to mount a new travellers onto rings in a ring spinning frame. When the delivery member 224 moves forward (as indicated by arrow in the figure), one traveller 207 in the guide member 223 is delivered to the front end while it is held down. The front end of the guide member 223 is bent so that the traveller 207 thus delivered is held in C shape vertically. When the traveller mounting means 222 advances, getting over the ring 215, and then moves back, the lower end of the traveller 207 is hooked to the ring 215 and fitted thereon.

Figure 12A:
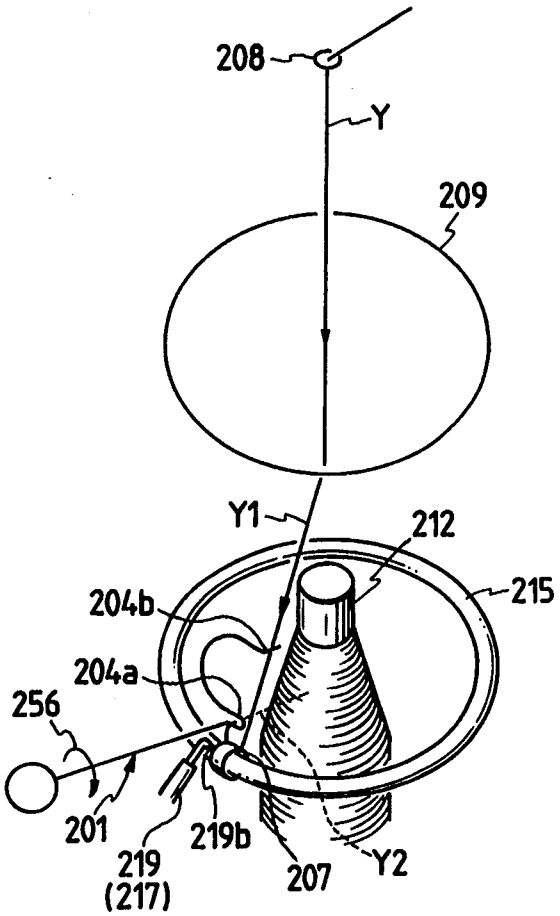
FIGS. 12*a*, 12*b* and 12*c* are views showing the operation of the yarn hooking lever in the traveller changer of the second embodiment.
Figure 12B:
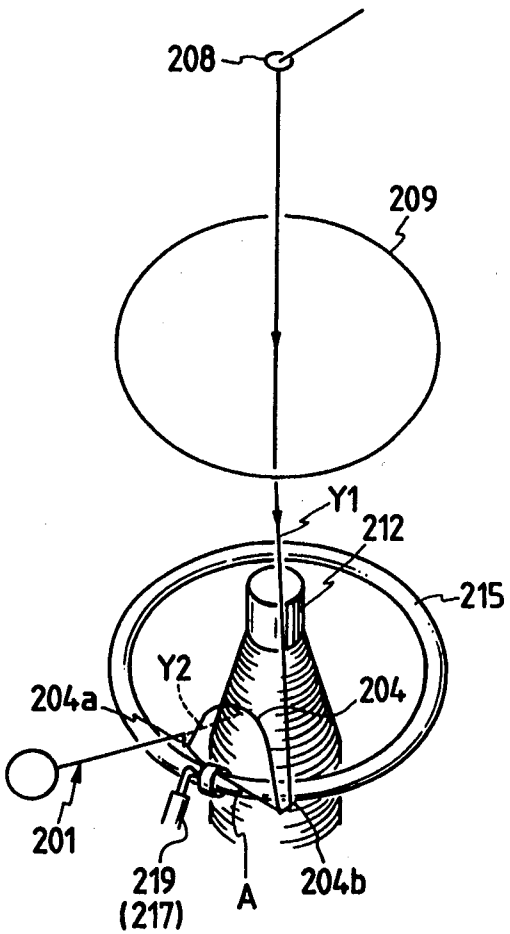
Figure 12C:
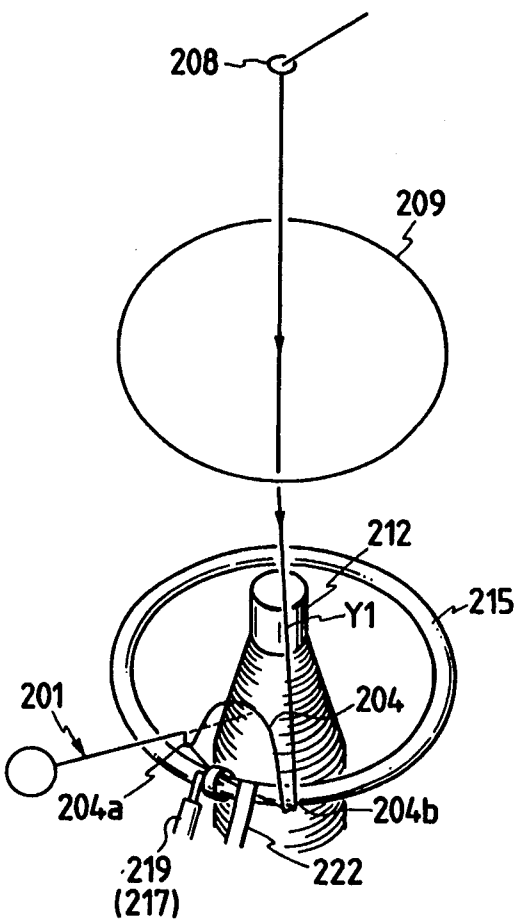

FIG. 12 schematically illustrates the operations of the yarn hooking lever 201, traveller removing means 217 and traveller mounting means 222 in the traveller changer of the invention. After the traveller 207 has stopped movement, the yarn hooking lever 201 is advanced over the ring 215 up to a position in which the upper yarn hooking portion 204*b* is close to the upper yarn Y1 and the lower yarn hooking portion 204*a* is close to the lower yarn, as shown in FIG. 12*a*. At this time, the traveller removing means 217 also advances up to the ring 215, allowing the pawl 219*a* of the arm 219 to be hooked to the traveller 207. Next, the yarn hooking lever 201 is turned in the direction of arrow 256. As a result, as shown in FIG. 12*b*, the upper and lower yarn hooking portions 204*b*, 204*a* of the yarn hooking lever 201 push the upper and lower yarns Y1, Y2, respectively, causing the yarn Y to cross over the circumference of the ring 215. At this time, at the intersecting point A, the upper yarn Y1 is in a floating state from the ring 215. And the traveller removing means 217 is positioned within the bent member 204 of the yarn hooking lever 201, not interfering with the lever 201. Then, at this intersecting point A, the traveller mounting means 222 is advanced to the ring 215 portion positioned within the bent member 204 of the yarn hooking lever 201 to mount a new traveller, as shown in FIG. 12C. Then, the traveller removing means 217 is turned, allowing the old traveller 207 to be surrounded by both the arm 219 and the presser plate 218. Thereafter, the traveller removing means 217 is moved toward the inner periphery of the ring 215 and the old traveller 207 is removed. At this time, since the old traveller is removed in a floating state of the upper yarn Y1 from the ring 215, an appropriate elasticity to an escaping degree from the ring 215 remains in the yarn, so even in the event the yarn is hooked to the old traveller when removed, there will be little breakage of the yarn.

Figure 13:
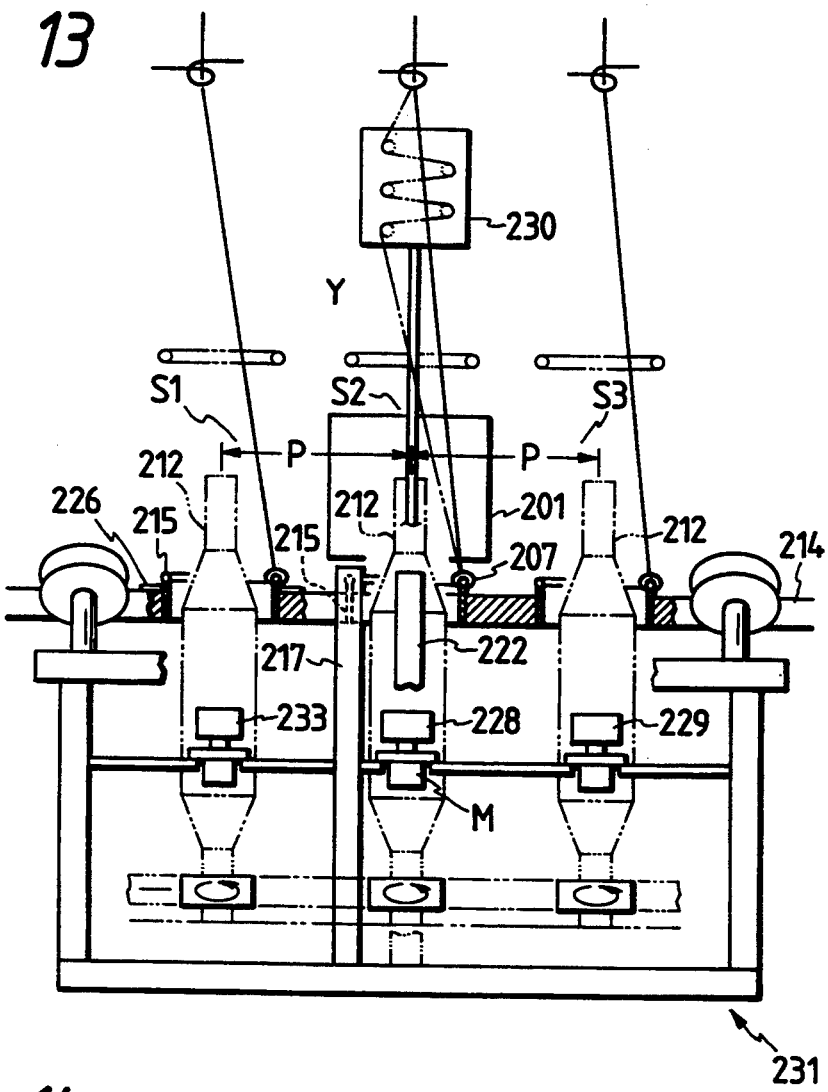
FIG. 13 is a view schematically showing an operation unit in the traveller changer of the second embodiment.
Figure 14:
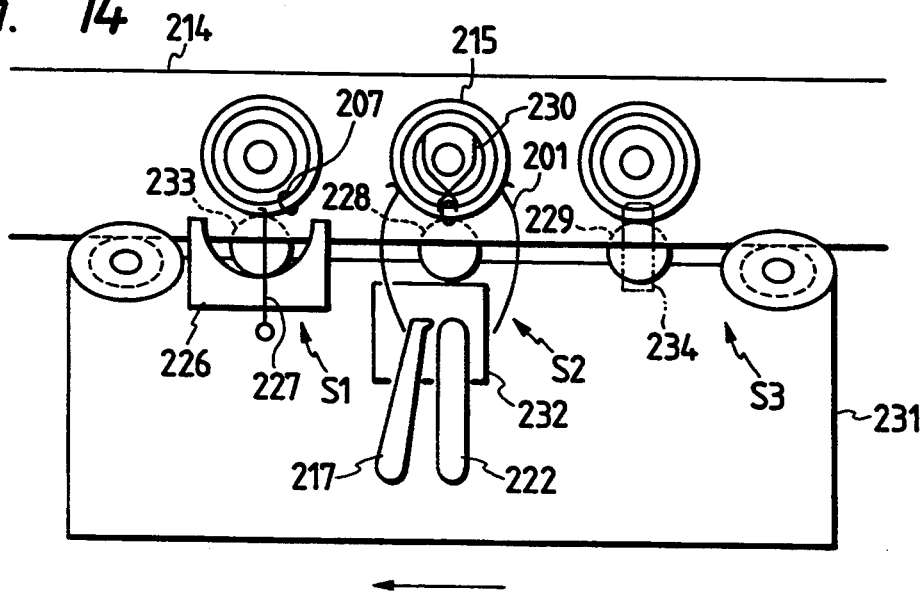
FIG. 14 is a top view of the operation unit in the second embodiment.

Next, an operation unit 231 with traveller changing devices carried thereon, including the yarn hooking means 201, traveller removing means 217 and traveller mounting means 222, will now be outlined with reference to FIGS. 13 and 14. FIG. 13 is a front view of the operation unit 231 and FIG. 14 is a top view thereof. The operation unit is supported vertically movably by a carrier unit (not shown) and is movable along the ring rail 214. The operation unit 231 is divided into three stations S1, S2 and S3. In the station S1 there are provided a positioning plate 226, a roller 233 and a lever 227. In the station S2 there are provided a recovery box 232, roller 228, tensor 230, yarn hooking lever 201, traveller removing means 217 and traveller mounting means 222. And in the station S3 there are provided a roller 229 and a slack eliminating means 234.

The following description is now provided about a traveller changing procedure carried out by the operation unit 231 described above. Roles are separated in such a manner that yarn is slackened in station S1, the change of traveller is performed in station S2, and yarn is brought into a tense state in station S3. In station S1, the roller 233 is positioned on the central bobbin 212 and rotates the bobbin in the reverse direction to slacken the yarn. The operation unit 231 moves to the left in the drawings by one pitch P into the illustrated state of station S2. At this time, the lever 227 causes the traveller 207 to move a little. The positioning plate 226 advances and is fitted on the ring 215 to effect positioning. Next, the yarn Y is stored by the tensor 230 and it becomes possible for the yarn to be delivered or fed under a predetermined yarn tension. Then, the front end of the traveller removing means 217 advances onto the ring 215 and the roller 228 causes the bobbin 212 to rotate in the forward direction, allowing the traveller 207 to move until it is hooked to the front end of the traveller removing means 217. Next, the yarn hooking lever 201 shifts the yarn in a crossing form over the ring 215, and after the traveller mounting means 222 has mounted a new traveller, the traveller removing means 217 removes the old traveller and puts it into the recovery box 232. Then, the tensor 230, the yarn hooking lever 201, the yarn removing means 217 and the traveller mounting means 222 are retracted and the operation unit 231 moves leftward in the drawings by one pitch P. Then, the roller 229 causes the bobbin 212 to rotate in the forward direction to take up the slackened yarn Y thereon, and the yarn is brought into a completely tense state by the slack eliminating means 234.

In the traveller changing method according to the present invention, yarn is hooked and shifted in a crossing form over a ring between upper and lower yarn portions with respect to a traveller, and the traveller removing operation is performed in a floating state of at least the upper yarn portion from the ring, whereby an appropriate elasticity to an escaping degree from the traveller is allowed to remain in the yarn to thereby prevent the yarn from being broken at the time removal of the old traveller.

In the traveller changer according to the present invention, as the rotary shaft of the yarn hooking lever rotates, upper and lower yarn portions are hooked and shifted in a crossing form over a ring by means of the upper and lower yarn hooking portions of the bent member, and the upper yarn portion is held in a floating state by adjusting the degree of rotation of the rotary shaft, whereby it is made possible to remove the old traveller while allowing an appropriate elasticity to remain in the yarn.

In the case of performing an automatic traveller change using the traveller changer described above, since a large number of ring spinning frames having a large number of spindles are arranged in series, it is necessary that the mounting of the traveller changer to each ring spinning frame be easy and that the transport thereof from one ring spinning from to another be also easy. In the prior art, however, if there is adopted a structure which facilitates the mounting of the traveller changer to each ring spinning frame, the transport of the traveller changer becomes inconvenient, and if the structure of the traveller changer is modified to facilitate its transport, the mounting thereof to each ring spinning frame becomes inconvenient.

A third embodiment of the present invention has been accomplished in view of the above-mentioned problem and it is the object of the invention to provide a traveller changer capable of being mounted easily to a ring spinning frame and also capable of being easily conveyed from one ring spinning frame to another.

The traveller changer of this embodiment of the present invention comprises an operation unit and a carrier unit which holds the operation unit vertically movably, the operation unit having means for causing the operation unit to travel while leaning against a ring rail and also having traveller changing means, the carrier unit having wheels for transport which stabilize the operation unit in a tilted posture during transport and also having wheels for operation which support the operation unit in a raised and leaned posture against the ring rail.

The operation unit is allowed to stand up in a tilted state by the transport wheels of the carrier unit and is conveyed between ring spinning frames, for example, by being pushed wholly by an operator. Since the operation unit adapted to lean against the ring rail is supported by the wheels for operation of the carrier unit, it is mounted to a ring spinning frame upon being tilted or lifted in the leaning direction wholly by the operator.

Figure 15B:
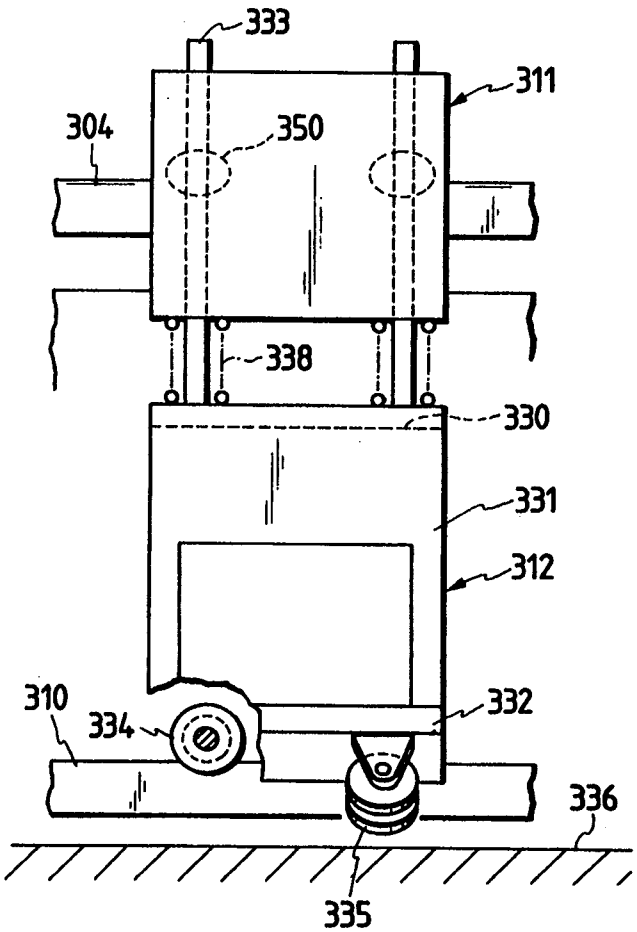
FIG. 15*a* is a side view showing the whole of a traveller changer according to a third embodiment of the present invention and 15*b* is a front view thereof.
Figure 15A:
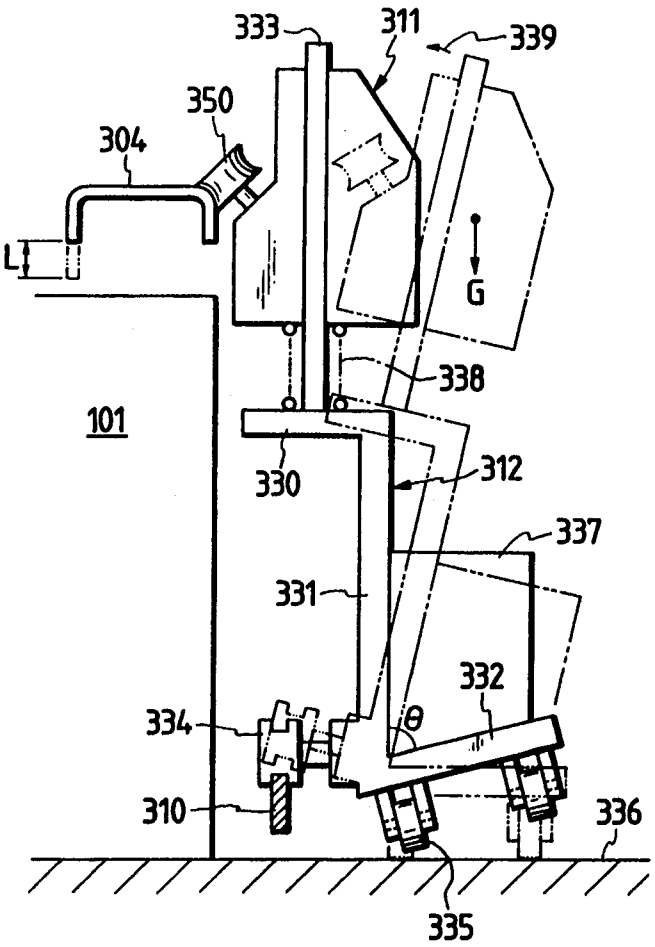

The third embodiment of the present invention will be described below with reference to the drawings. FIG. 15 is a view showing the whole of a traveller changer embodying the invention, in which FIG. 15*a* is a side view and FIG. 15*b* is a front view.

In FIG. 15, the traveller changer comprises an operation unit 311 and a carrier unit 312 which holds the operation unit 311 vertically movably. The carrier unit 312 is substantially in the form of a Z-shaped frame which comprises, in a side view, an upper portion 330, a side portion 331 and a lower portion 332. A support rod 333 is erected on the upper portion 330, two wheels 334 for operation adapted to be put on a rail 310 are each supported through a shaft on the side portion 331 of the frame, and four wheels 335 for transport are each supported through a shaft on the frame lower portion 332. The lower portion 332 is formed at an angle $\theta$ which is a little smaller than 90° relative to the side portion 331. When the operation wheels 334 are put on the rail 310 and the operation unit 311 lean against a ring rail 304 (as indicated by a solid lines in the figure), the transport wheels 335 are in a floating state from a floor 336. When the transport wheels 335 are on the floor 336, the support rod 333 and the operation unit 311 are in an inclined state (as indicated by dash-double dot lines in the figure). At this time, the center of gravity, G, of the operation unit 311 points to the middle part between the transport wheels 335. The numeral 337 denotes a power operating unit, which can be put on a carrier separate from the carrier unit 312 and then connected to the carrier unit 312.

The operation unit 311 has wheels 350 with magnet as means for causing the operation unit to travel while leaning against the ring rail 304. The operation unit 311 is movable vertically along the support rod 333 through a linear bearing or the like, and is held so that it can follow up the ring rail 304 in any position within a reciprocating section L of the ring rail while its weight is borne by means of a spring 338. The leaned state of the operation unit 311 against the ring rail 304 is retained by the wheels 350 with magnet, and when the wheels 350 are driven, the operation unit 311 travels along the ring rail 304.

Figure 16A:
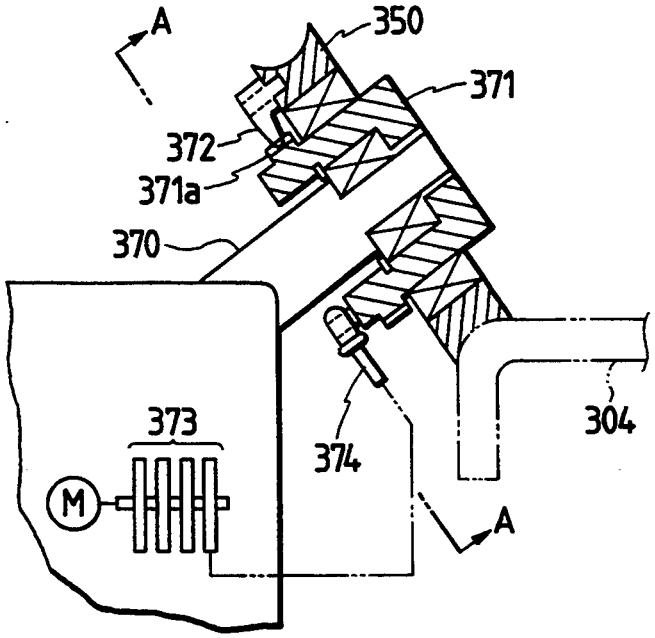
FIG. 16*a* is a sectional view showing a structure of a wheel used in an operation unit in the third embodiment and FIG. 16*b* is a sectional view taken along a line A—A in FIG. 16*a;*
Figure 16B:
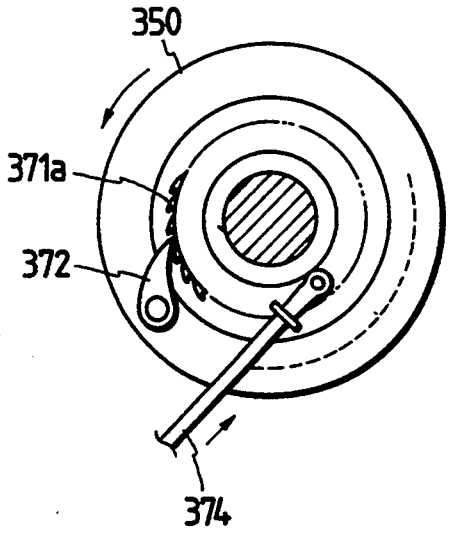

The wheels 350 will now be described in more detail with reference to FIG. 16, in which FIG. 16*a* is a sectional view and FIG. 16*b* is a sectional view taken on line A—A in FIG. 16*a*. Each wheel 350 has a magnet fitted in a recess formed in its outer periphery, whereby the wheel is attracted to a corner of the ring rail 304 and is driven by link and cam mechanism. More specifically, an intermediate rotary member 371 is supported rotatably on a stationary shaft 370, and the wheel 350 is supported rotatable by the intermediate rotary member 371. A ratchet wheel 371*a* is fitted on the intermediate rotary member 371, and a ratch 372 which meshes with the rachet pawl 371*a* in one direction and slips in an opposite direction is attached to the wheel 350. To the outer periphery of the intermediate rotary member 371 is connected a link 374 which is reciprocated by a cam train 373. The cam train 373 is for actuating various devices, including a traveller mounting means, and the link 374 is thereby reciprocated at a predetermined timing. When the link 374 moves in the direction arrow, the wheel 350 rotates in its arrowed direction through the ratchet wheel 371*a* and ratch 372, and the operation unit moves rapidly by a distance corresponding to an arrangement pitch of rings, then is positioned for a ring on the ring rail 304 by means of a positioning mechanism (not shown). The link and cam mechanism may be substituted by a motor to rotate the wheel 350.

Figure 17A:
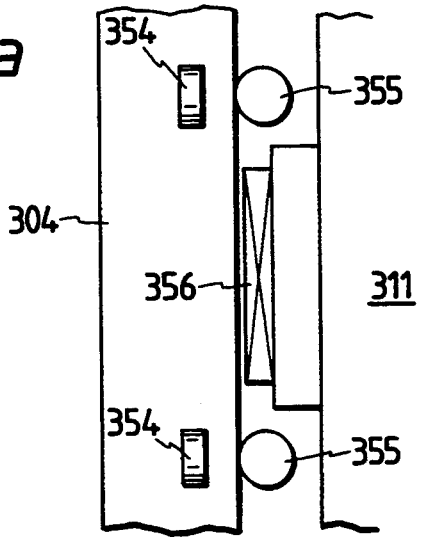
FIG. 17*a* is a structural diagram of another wheel used in the operation unit in the third embodiment and FIG. 17*b* is a side view thereof.
Figure 17B:
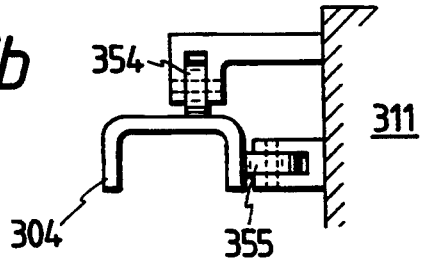

FIG. 17 shows an example in which the magnet attached to the wheel 350 in FIG. 16 is provided separately. FIG. 17*a* is a top view and FIG. 17*b* is a side view. Vertical wheels 354 and lateral wheels 355 are put on the ring rail 304, and a magnet 356 is attached to the operation unit 311 in a suitable position. Even if the wheels 354 and 355 are standard ones, a minimum gap is set between the ring rail 304 and the magnet 356, thereby allowing a strong attractive force to work on between the ring rail 304 and the operation unit 311.

Description is now directed to the mounting and transport of the traveller changer described above to a ring spinning frame. In FIG. 15, in a contacted state of the transport wheels 335 on the floor 336, as indicated by dash-double dot lines, the center of gravity, G, is positioned in the middle part between the transport wheels 335, so that the operation unit 311 is stable while maintaining a self-standing state. Therefore, the operator can push the operation unit 311 for example and transport the whole of the traveller changer up to a predetermined ring spinning frame. When the dash-double dot line position is reached, the operator tilts the operation unit 311 in the direction of arrow 339, whereby the transport wheels 334 are put on the rail 310. Then, the height of the operation unit 311 is adjusted to the height of the ring rail 304 which is at a standstill, and the wheel 350 with magnet is attracted to the ring rail 304, thus affording the mounted state indicated by the solid lines. The weight of the operation unit 311 leaning against the ring rail 304 like the solid lines is borne by the wheels 334 for operation, while the transport wheels 335 are in a floating state from the floor 336.

For the change of ring, the wheel 350 rotates in a predetermined manner by the link 374 shown in FIG. 16, and the operation unit 311 can move for each arrangement pitch of rings on the ring rail 304.

Figure 18B:
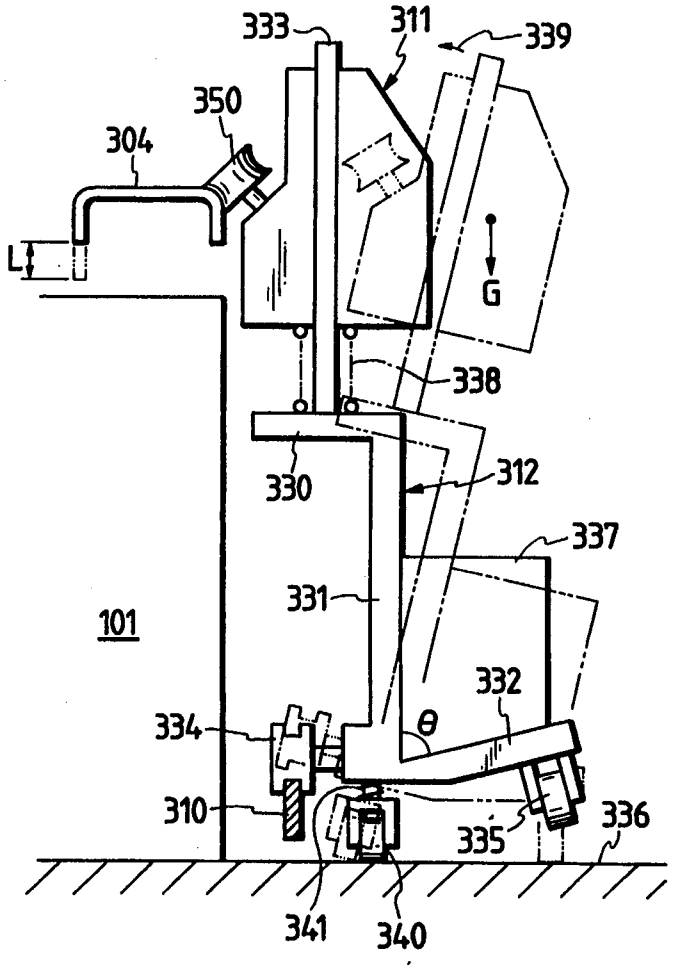
FIGS. 18*a* and 18*b* are side views of a traveller changer according to a further embodiment of the present invention.
Figure 18A:
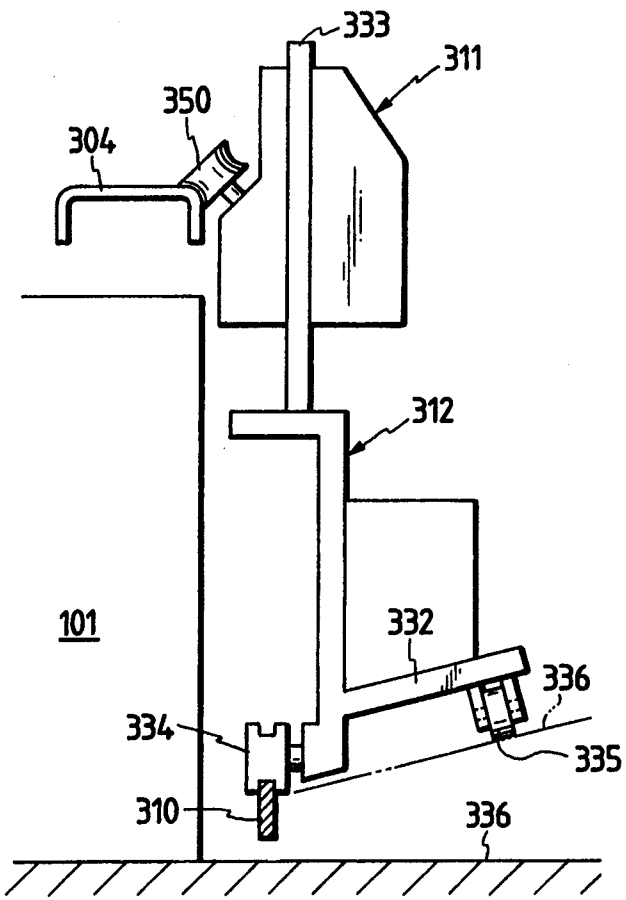
Figure 19:
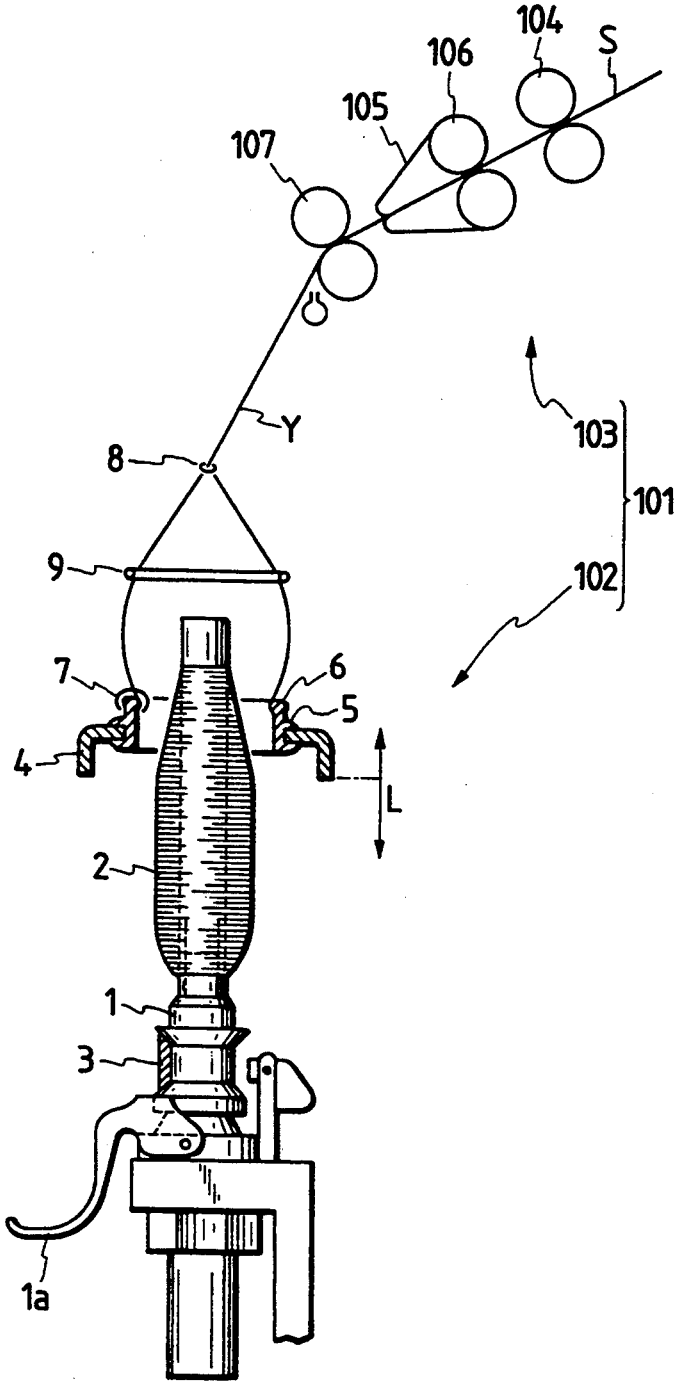
FIG. 19 PRIOR ART
FIG. 19 is a front view of a ring spinning frame.

FIG. 18 illustrates other examples of carrier units. The carrier unit shown in FIG. 18*a* is different from that shown in FIG. 15 in that the two wheels 334 for operation shown in FIG. 15 also serve as transport wheels in this example. More specifically, a lower portion 332 of a carrier unit 312 is located in a higher position than in FIG. 15, and to the lower portion 332 are mounted two transport wheels 335 less than the four in FIG. 15. The level of the floor 336 during transport rises to the dash-double dot line position during operation, so after the operator has conveyed the whole of the traveller changer up to the ring spinning frame side, the whole is lifted and the wheels 334 are put on the rail 310. The carrier unit shown in FIG. 18*b* is different from that in FIG. 15 in that the transport wheels 335 described in FIG. 15 serves as wheels 340 for operation and wheels for transport in this example. More specifically, a wheel 340 is supported through a spring 341 so as not to exert an influence on the travelling accuracy of the operation unit 311. During transport, the wheel 340 rotates on the floor 336 as indicated by a dash-double dot line. In the case where the rail 310 is not used, it is desirable that the wheels 340 for operation also serve as wheels for transport as in FIG. 18*b*, for travelling on the floor 336.

An outline of the operation unit 311 with traveller changing devices mounted therein and a traveller changing procedure using the operation unit 311 are the same as those illustrated in FIGS. 13 and 14, so will not be described here.

The traveller changer of the present invention comprises an operation unit and a carrier unit which holds the operation unit vertically movably, the operation unit having means for causing the operation unit to travel while leaning against a ring rail and also having traveller changing means, the operation unit having wheels for transport which stabilize the operation unit in a tilted posture during transport and also having wheels for operation which support the operation unit in a raised and leaned posture against the ring rail. The traveller changer is conveyed between ring spinning frames, for example by pushing the whole by an operator in a tilted and self-standing state of the operation unit, and it is mounted to a ring spinning frame when the operator tilts or lifts the whole in the leaning direction against the ring rail. Thus, the mounting and transport of the traveller changer to a ring spinning frame can be done easily.

What is claimed is:

1. A device for changing a traveller on a ring in a ring spinning frame for spinning yarn, the yarn having an upper yarn portion and a lower yarn portion, the ring having a circumference, the device comprising:

a rotary shaft advancable toward the ring and rotatable relative to the ring, the rotary shaft having a front end, a bent member formed substantially at the front end of the rotary shaft, the bent member having a first end and a second end, the first end being relatively closer to the rotary shaft than the second end, a lower yarn hooking section formed substantially at the first end of the bent member for hooking the lower yarn portion, and an upper yarn hooking section formed substantially at the second end of the bent member for hooking the upper yarn portion and holding the upper yarn portion in a position at which the upper yarn is at an angle relative to the circumference of the ring and is in spaced relationship with the ring, whereby a traveller is removable from the ring when the upper yarn is held in spaced relationship with the ring.

2. The device of claim 1, comprising:

traveller mounting means for mounting a traveller on the ring, and traveller removing means for removing a traveller from the ring.

3. A method for changing a traveller on a ring in a ring spinning frame for spinning yarn, the yarn having an upper yarn portion and a lower yarn portion, the ring having a circumference, the method comprising:

providing a rotary shaft having a front end, providing a bent member substantially at the front end of the rotary shaft, the bent member having a first end and a second end, the first end being relatively closer to the rotary shaft than the second end, providing a lower yarn hooking section substantially at the first end of the bent member, providing an upper yarn hooking section substantially at the second end of the bent member, advancing the rotary shaft toward the ring rotating the rotary shaft relative to the ring, hooking the lower yarn portion with the lower yarn hooking section, hooking the upper yarn portion with the upper yarn hooking section, holding the upper yarn portion in a position at which the upper yarn is at an angle relative to the circumference of the ring and is in spaced relationship with the ring, whereby a traveller is removable from the ring when the upper yarn is held in spaced relationship with the ring.

4. The method of claim 3, comprising:

removing a traveller from the ring when the upper yarn is held in spaced relationship with the ring by the upper yarn hooking section, and mounting a traveller on the ring when the upper yarn is held in spaced relationship with the ring by the upper yarn hooking section.

* * * * *